US010553943B2

(12) United States Patent
Tran

(10) Patent No.: US 10,553,943 B2
(45) Date of Patent: Feb. 4, 2020

(54) LOW-COST SATELLITE USER TERMINAL ANTENNA

(71) Applicant: QUALCOMM Incorporated, San Diego, CA (US)

(72) Inventor: Allen Minh-Triet Tran, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 453 days.

(21) Appl. No.: 14/861,921

(22) Filed: Sep. 22, 2015

(65) Prior Publication Data

US 2017/0084994 A1 Mar. 23, 2017

(51) Int. Cl.

| | |
|---|---|
| ***H01Q 3/24*** | (2006.01) |
| ***H01Q 15/08*** | (2006.01) |
| ***H01Q 13/00*** | (2006.01) |
| ***H01Q 3/14*** | (2006.01) |

(52) U.S. Cl.

CPC ..... *H01Q 3/245* (2013.01); *H01Q 3/14* (2013.01); *H01Q 3/24* (2013.01); *H01Q 13/00* (2013.01); *H01Q 15/08* (2013.01)

(58) Field of Classification Search

CPC ..... H01Q 3/24; H01Q 19/06–062

See application file for complete search history.

(56) References Cited

U.S. PATENT DOCUMENTS

| | | | | |
|---|---|---|---|---|
| 3,404,405 | A * | 10/1968 | Young, Jr. | H01Q 3/245 343/754 |
| 3,833,909 | A * | 9/1974 | Schaufelberger | H01Q 3/14 343/754 |
| 5,736,959 | A | 4/1998 | Patterson et al. | |
| 5,821,908 | A | 10/1998 | Sreenivas | |
| 5,936,588 | A | 8/1999 | Rao et al. | |
| 6,262,688 | B1 | 7/2001 | Kasahara | |
| 6,281,853 | B1 * | 8/2001 | Caille | H01Q 3/02 343/753 |
| 6,292,134 | B1 | 9/2001 | Bondyopadhyay | |
| 7,212,169 | B2 | 5/2007 | Ogawa et al. | |
| 2006/0028386 | A1 * | 2/2006 | Ebling | H01Q 13/24 343/754 |
| 2007/0001918 | A1 | 1/2007 | Ebling et al. | |
| 2015/0116154 | A1 * | 4/2015 | Artemenko | H01Q 15/08 342/371 |

FOREIGN PATENT DOCUMENTS

WO 2009100153 A1 8/2009

OTHER PUBLICATIONS

International Search Report and Written Opinion—PCT/US2016/051869—ISA/EPO—dated Nov. 28, 2016.

* cited by examiner

*Primary Examiner* — Jessica Han
*Assistant Examiner* — Amal Patel
(74) *Attorney, Agent, or Firm* — Muncy, Geissler, Olds & Lowe, P.C.

(57) ABSTRACT

A beam steering antenna is provided in a user terminal for satellite communications. The beam steering antenna includes an antenna feed structure having a plurality of feed elements configured to be switched on or off to form an initial beam, and a focus lens positioned adjacent to the antenna feed structure to form a focused beam. The antenna feed structure may include a plurality of active waveguide feed elements to generate a circularly polarized initial beam. The focus lens may be a spherical lens to form a circularly polarized focused beam.

31 Claims, 11 Drawing Sheets

LOW-COST SATELLITE USER TERMINAL ANTENNA

INTRODUCTION

Various aspects described herein relate to satellite communications, and more particularly, to satellite user terminals in non-geosynchronous satellite communication systems.

Conventional satellite-based communication systems include gateways and one or more satellites to relay communication signals between the gateways and one or more user terminals. A gateway is an Earth station having an antenna for transmitting signals to, and receiving signals from, communication satellites. A gateway provides communication links, using satellites, for connecting a user terminal to other user terminals or users of other communication systems, such as a public switched telephone network, the Internet and various public and/or private networks. A satellite is an orbiting receiver and repeater used to relay information.

A satellite can receive signals from and transmit signals to a user terminal provided the user terminal is within the "footprint" of the satellite. The footprint of a satellite is the geographic region on the surface of the Earth within the range of signals of the satellite. The footprint is usually geographically divided into "beams," through the use of beamforming antennas. Each beam covers a particular geographic region within the footprint. Beams may be directed so that more than one beam from the same satellite covers the same geographic region.

Geosynchronous satellites have long been used for communications. A geosynchronous satellite is stationary relative to a given location on the Earth, and thus, there is little timing shift and Doppler frequency shift in radio signal propagation between a communication transceiver on the Earth and the geosynchronous satellite. However, because geosynchronous satellites are limited to a geosynchronous orbit (GSO), which is a circle having a radius of approximately 42,164 km from the center of the Earth directly above the Earth's equator, the number of satellites that may be placed in the GSO is limited. As alternatives to geosynchronous satellites, communication systems which utilize a constellation of satellites in non-geosynchronous orbits, such as low-earth orbits (LEO), have been devised to provide communication coverage to the entire Earth or at least large parts of the Earth.

Compared to GSO satellite-based and terrestrial communication systems, non-geosynchronous satellite-based systems, such as LEO satellite-based systems, may present challenges for a user terminal (UT) in communication with the satellites because the satellites are not stationed at fixed positions relative to the UT. A communication satellite in a non-geosynchronous orbit may be moving at significant angular velocities in azimuth and in elevation with respect to a UT on the Earth. In order to maintain communications with a given satellite or to handover communications with different satellites in a non-geosynchronous satellite communication system, the UT may be required to perform fast beam steering between widely divergent angles in azimuth and/or elevation.

It is desirable to provide a low-cost, low-complexity, high-performance and reliable antenna for the UT for voice, data, video, or other types of communications in a satellite communication system. It is desirable that the radio antenna for a user terminal have a beam steering capability such that the beam can be pointed to an angular position within the given field-of-view of coverage. Various schemes have been devised to provide antennas with beam steering capabilities for satellite ground stations.

For example, dish or lens antennas with mechanical motors have been devised to mechanically steer a fixed antenna beam to point at an angle directed toward a serving satellite. However, mechanical beam scanning is typically much slower than electronic beam scanning. Moreover, mechanical beam scanning in a satellite user terminal typically requires two independent antenna units or one antenna with two independent mechanically moveable feeds to achieve adequate handoff time between two satellites without dropping service or reducing the throughput at the user terminal.

Electronically steerable phased-array antennas have also been devised for satellite user terminals in order to achieve faster scanning, but phased-array antennas are typically more expensive than mechanically steered antennas. Moreover, when a beam generated by a typical phased-array antenna is electronically steered to a large off-boresight angle, the effective aperture size of the phased-array antenna is larger, thereby resulting in a wider beam width and a lower effective antenna gain. Thus, electronically steerable phase-array antennas may not be able to satisfy the requirements of low cost, fast beam steering, and adequate antenna gain for a user terminal.

SUMMARY

Aspects of the disclosure are directed to apparatus and methods for beam steering by user terminals in satellite communication systems.

In one aspect, a user terminal is provided, the user terminal comprising: a transceiver; and an antenna coupled to the transceiver, the antenna comprising: an antenna feed structure comprising a plurality of feed elements, at least one of the feed elements configured to be switched on or off to form an initial beam; and a focus lens positioned adjacent to the antenna feed structure to form a focused beam based on the initial beam.

In another aspect, an antenna is provided, the antenna comprising: an antenna feed structure comprising a plurality of feed elements, at least one of the feed elements configured to be switched on or off to form an initial beam; and a focus lens positioned adjacent to the antenna feed structure to form a focused beam based on the initial beam.

In yet another aspect, a method of steering a beam is provided, the method comprising: selectively switching on or off at least one of a plurality of feed elements in an antenna feed structure to form an initial beam; and focusing the initial beam to form a focused beam.

BRIEF DESCRIPTION OF THE DRAWINGS

The accompanying drawings are presented to aid in the description of aspects of the disclosure and are provided solely for illustration of the aspects and not limitations thereof.

DETAILED DESCRIPTION

Figure 1:
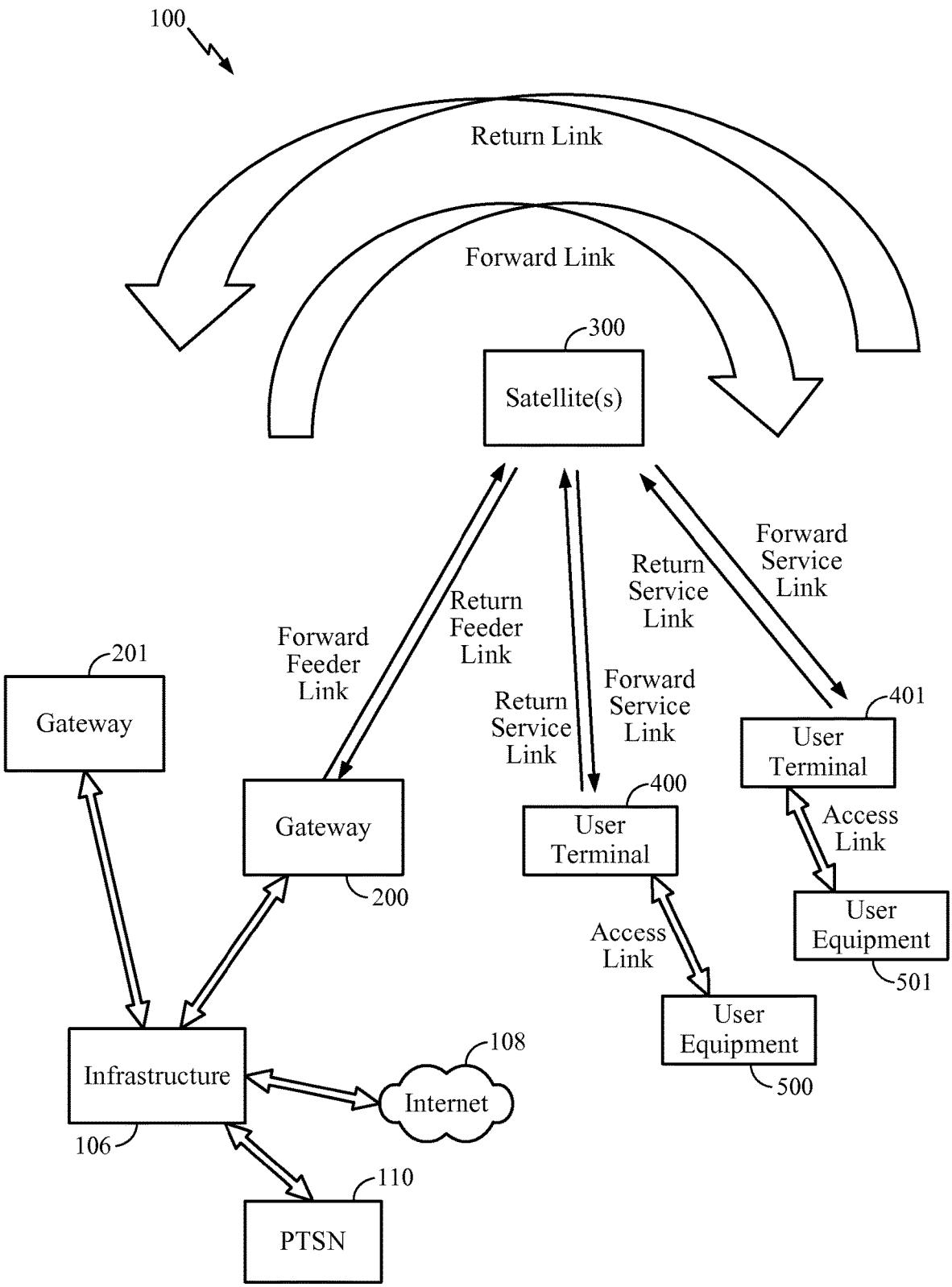
FIG. 1 is a block diagram of an example of a communication system.

Various aspects of the disclosure relate to apparatus and methods for beam steering by user terminals (UTs) in communication with one or more satellites in a non-synchronous satellite communication system, such as a low-earth orbit (LEO) satellite communication system for data, voice, or video communications. In one aspect, a user terminal includes a transceiver and an antenna comprising an antenna feed structure having a plurality of feed elements. In one aspect, at least one of the feed elements is configured to be switched on or off to form an initial beam, and a focus lens is positioned adjacent to the antenna feed structure to form a focused beam based on the initial beam. In one aspect, the antenna feed structure is a waveguide feed, and the feed elements are active waveguide feed elements. In one aspect, the initial beam is circularly polarized. In one aspect, the focus lens is a spherical lens for forming a circularly polarized focused beam. In another aspect, a method of steering radio frequency (RF) beams is provided for a user terminal in a satellite communication system, the method including selectively switching on or off at least one of the feed elements in an antenna feed structure to form an initial beam, and focusing the initial beam to form a focused beam. Various other aspects of the disclosure will also be described below in further detail.

Specific examples of the disclosure are described in the following description and related drawings. Alternate examples may be devised without departing from the scope of the disclosure. Additionally, well-known elements will not be described in detail or will be omitted so as not to obscure the relevant details of the disclosure.

The word "exemplary" is used herein to mean "serving as an example, instance, or illustration." Any aspect described herein as "exemplary" is not necessarily to be construed as preferred or advantageous over other aspects. Likewise, the term "aspects" does not require that all aspects include the discussed feature, advantage, or mode of operation.

The terminology used herein is for the purpose of describing particular aspects only and is not intended to be limiting of the aspects. As used herein, the singular forms "a," "an," and "the" are intended to include the plural forms as well, unless the context clearly indicates otherwise. It will be further understood that the terms "comprises," "comprising," "includes," or "including," when used herein, specify the presence of stated features, integers, steps, operations, elements, or components, but do not preclude the presence or addition of one or more other features, integers, steps, operations, elements, components, or groups thereof. Moreover, it is understood that the word "or" has the same meaning as the Boolean operator "OR," that is, it encompasses the possibilities of "either" and "both" and is not limited to "exclusive or" ("XOR"), unless expressly stated otherwise. It is also understood that the symbol "/" between two adjacent words has the same meaning as "or" unless expressly stated otherwise. Moreover, phrases such as "connected to," "coupled to," or "in communication with" are not limited to direct connections unless expressly stated otherwise.

Further, many aspects are described in terms of sequences of actions to be performed by, for example, elements of a computing device. It will be recognized that various actions described herein can be performed by specific circuits, for example, central processing units (CPUs), graphic processing units (GPUs), digital signal processors (DSPs), application-specific integrated circuits (ASICs), field programmable gate arrays (FPGAs), or various other types of general purpose or special purpose processors or circuits, by program instructions being executed by one or more processors, or by a combination of both. Additionally, the sequence of actions described herein can be considered to be embodied entirely within any form of computer-readable storage medium having stored therein a corresponding set of computer instructions that upon execution would cause an associated processor to perform the functionality described herein. Thus, the various aspects of the disclosure may be embodied in a number of different forms, all of which have been contemplated to be within the scope of the claimed subject matter. In addition, for each of the aspects described herein, the corresponding form of any such aspects may be described herein as, for example, "logic configured to" perform the described action.

FIG. 1 illustrates an example of a satellite communication system 100 which includes a plurality of satellites (although only one satellite 300 is shown for clarity of illustration) in non-geosynchronous orbits, for example, low-earth orbits (LEO), a gateway 200 in communication with the satellite 300, a plurality of user terminals (UTs) 400 and 401 in communication with the satellite 300, and a plurality of user equipment (UE) 500 and 501 in communication with the UTs 400 and 401, respectively. Each UE 500 or 501 may be a user device such as a mobile device, a telephone, a smartphone, a tablet, a laptop computer, a computer, a wearable device, a smart watch, an audiovisual device, or any device including the capability to communicate with a UT. Additionally, the UE 500 and/or UE 501 may be a device (e.g., access point, small cell, etc.) that is used to communicate with one or more end user devices. In the example illustrated in FIG. 1, the UT 400 and the UE 500 communicate with each other via a bidirectional access link (having a forward access link and return access link), and similarly, the UT 401 and the UE 501 communicate with each other via another bidirectional access link. In another implementation, one or more additional UEs (not shown) may be configured to receive only and therefore communicate with a UT only using a forward access link. In another implementation, one or more additional UEs (not shown) may also communicate with the UT 400 or UT 401. Alternatively, a UT and a corresponding UE may be integral parts of a single physical device, such as a mobile telephone with an integral satellite transceiver and an antenna for communicating directly with a satellite, for example.

The gateway 200 may have access to Internet 108 or one or more other types of public, semiprivate, or private networks. In the example illustrated in FIG. 1, the gateway 200 is in communication with infrastructure 106, which is capable of accessing the Internet 108 or one or more other types of public, semiprivate or private networks. The gateway 200 may also be coupled to various types of communication backhaul, including, for example, landline networks such as optical fiber networks or public switched telephone networks (PSTN) 110. Further, in alternative implementations the gateway 200 may interface to the Internet 108, the PSTN 110, or one or more other types of public, semiprivate, or private networks without using the infrastructure 106. Furthermore, the gateway 200 may communicate with other gateways, such as gateway 201 through the infrastructure 106 or alternatively may be configured to communicate to the gateway 201 without using the infrastructure 106. The infrastructure 106 may include, in whole or part, a network control center (NCC), a satellite control center (SCC), a wired and/or wireless core network, and/or any other components or systems used to facilitate operation of and/or communication with the satellite communication system 100.

Communications between the satellite 300 and the gateway 200 in both directions are called feeder links, whereas communications between the satellite 300 and each of the UTs 400 and 401 in both directions are called service links. A signal path from the satellite 300 to a ground station, which may be the gateway 200 or one of the UTs 400 and 401, may be generically called a downlink. A signal path from a ground station to the satellite 300 may be generically called an uplink. Additionally, as illustrated, signals can have a general directionality such as a forward link and a return link or reverse link. Accordingly, a communication link in a direction originating from the gateway 200 and terminating at the UT 400 through the satellite 300 is called a forward link, whereas a communication link in a direction originating from the UT 400 and terminating at the gateway 200 through the satellite 300 is called a return link or reverse link. As such, the signal path from the gateway 200 to the satellite 300 is labeled "Forward Feeder Link" whereas the signal path from the satellite 300 to the gateway 200 is labeled "Return Feeder Link" in FIG. 1. In a similar manner, the signal path from each UT 400 or 401 to the satellite 300 is labeled "Return Service Link" whereas the signal path from the satellite 300 to each UT 400 or 401 is labeled "Forward Service Link" in FIG. 1.

Figure 2:
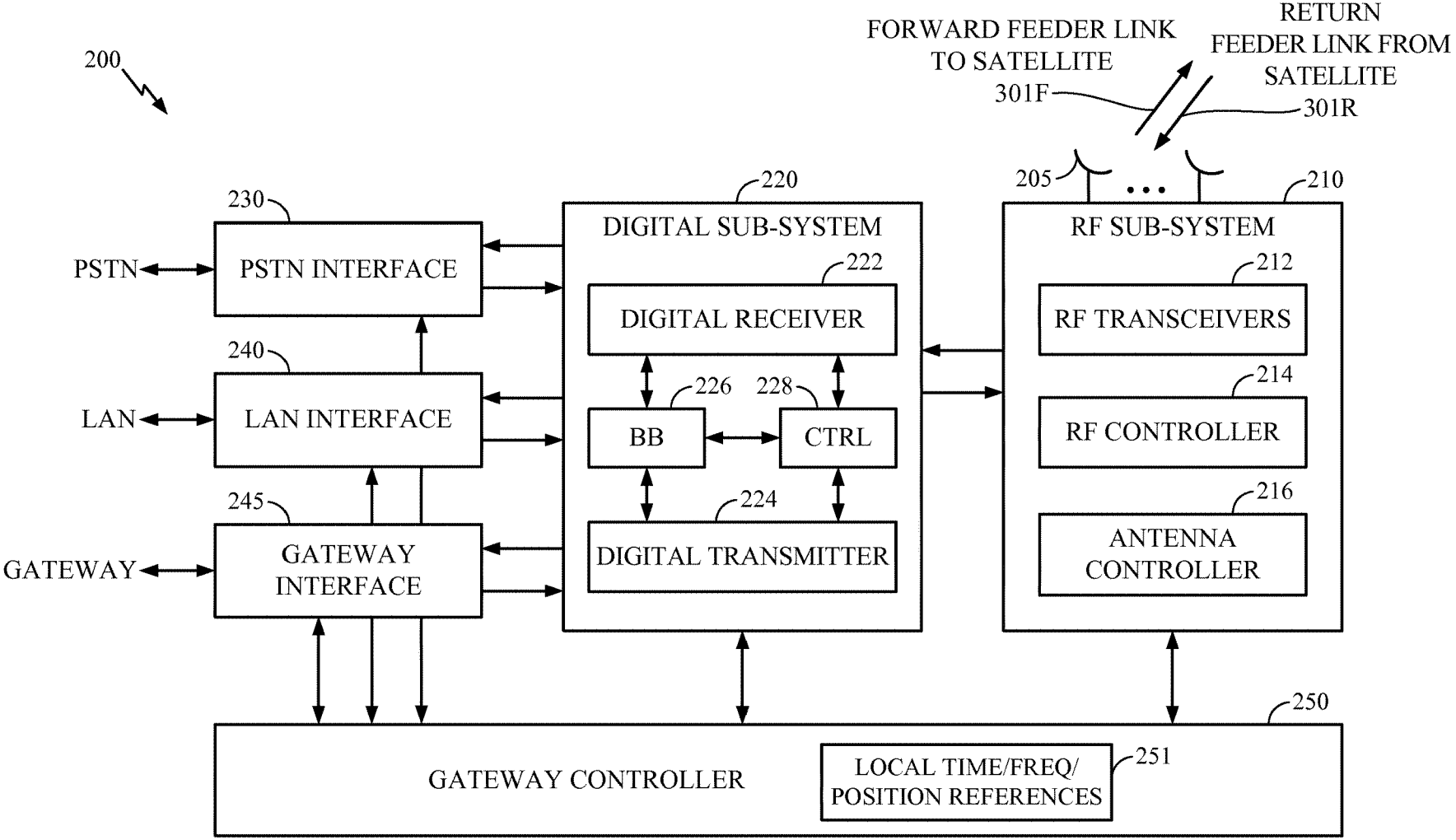
FIG. 2 is a block diagram of an example of the gateway of FIG. 1.

FIG. 2 is an example block diagram of the gateway 200, which also can apply to the gateway 201 of FIG. 1. The gateway 200 is shown to include a number of antennas 205, an RF subsystem 210, a digital subsystem 220, a Public Switched Telephone Network (PSTN) interface 230, a Local Area Network (LAN) interface 240, a gateway interface 245, and a gateway controller 250. The RF subsystem 210 is coupled to the antennas 205 and to the digital subsystem 220. The digital subsystem 220 is coupled to the PSTN interface 230, to the LAN interface 240, and to the gateway interface 245. The gateway controller 250 is coupled to the RF subsystem 210, the digital subsystem 220, the PSTN interface 230, the LAN interface 240, and the gateway interface 245.

The RF subsystem 210, which may include a number of RF transceivers 212, an RF controller 214, and an antenna controller 216, may transmit communication signals to the satellite 300 via a forward feeder link 301F, and may receive communication signals from the satellite 300 via a return feeder link 301R. Although not shown for simplicity, each of the RF transceivers 212 may include a transmit chain and a receive chain. Each receive chain may include a low noise amplifier (LNA) and a down-converter (e.g., a mixer) to amplify and down-convert, respectively, received communication signals in a well-known manner. In addition, each receive chain may include an analog-to-digital converter (ADC) to convert the received communication signals from analog signals to digital signals (e.g., for processing by digital subsystem 220). Each transmit chain may include an up-converter (e.g., a mixer) and a power amplifier (PA) to up-convert and amplify, respectively, communication signals to be transmitted to the satellite 300 in a well-known manner. In addition, each transmit chain may include a digital-to-analog converter (DAC) to convert the digital signals received from the digital subsystem 220 to analog signals to be transmitted to the satellite 300.

The RF controller 214 may be used to control various aspects of the number of RF transceivers 212 (e.g., selection of the carrier frequency, frequency and phase calibration, gain settings, and the like). The antenna controller 216 may control various aspects of the antennas 205 (e.g., beamforming, beam steering, gain settings, frequency tuning, and the like).

The digital subsystem 220 may include a number of digital receiver modules 222, a number of digital transmitter modules 224, a baseband (BB) processor 226, and a control (CTRL) processor 228. The digital subsystem 220 may process communication signals received from the RF subsystem 210 and forward the processed communication signals to the PSTN interface 230 and/or the LAN interface 240, and may process communication signals received from the PSTN interface 230 and/or the LAN interface 240 and forward the processed communication signals to the RF subsystem 210.

Each digital receiver module 222 may correspond to signal processing elements used to manage communications between the gateway 200 and the UT 400. One of the receive chains of the RF transceivers 212 may provide input signals to the digital receiver modules 222. A number of digital receiver modules 222 may be used to accommodate all of the satellite beams and possible diversity mode signals being handled at any given time. Although not shown for simplicity, each digital receiver module 222 may include one or more digital data receivers, a searcher receiver, and a diversity combiner and decoder circuit. The searcher receiver may be used to search for appropriate diversity modes of carrier signals, and may be used to search for pilot signals (or other relatively fixed pattern strong signals).

The digital transmitter modules 224 may process signals to be transmitted to the UT 400 via the satellite 300. Although not shown for simplicity, each digital transmitter module 224 may include a transmit modulator that modulates data for transmission. The transmission power of each transmit modulator may be controlled by a corresponding digital transmit power controller (not shown for simplicity) that may (1) apply a minimum level of power for purposes of interference reduction and resource allocation and (2) apply appropriate levels of power when needed to compensate for attenuation in the transmission path and other path transfer characteristics.

The control processor (CTRL) 228, which is coupled to the digital receiver modules 222, the digital transmitter modules 224, and the baseband processor (BB) 226, may provide command and control signals to effect functions such as, but not limited to, signal processing, timing signal generation, power control, handoff control, diversity combining, and system interfacing.

The control processor (CTRL) 228 may also control the generation and power of pilot, synchronization, and paging channel signals and their coupling to the transmit power controller (not shown for simplicity). The pilot channel is a signal that is not modulated by data, and may use a repetitive unchanging pattern or non-varying frame structure type (pattern) or tone type input. For example, the orthogonal function used to form the channel for the pilot signal generally has a constant value, such as all 1's or 0's, or a well-known repetitive pattern, such as a structured pattern of interspersed 1's and 0's.

The baseband processor (BB) 226 is well known in the art and is therefore not described in detail herein. For example, the baseband processor (BB) 226 may include a variety of known elements such as (but not limited to) coders, data modems, and digital data switching and storage components.

The PSTN interface 230 may provide communication signals to, and receive communication signals from, an external PSTN either directly or through the infrastructure 106, as illustrated in FIG. 1. The PSTN interface 230 is well known in the art, and therefore is not described in detail herein. For other implementations, the PSTN interface 230 may be omitted, or may be replaced with any other suitable interface that connects the gateway 200 to a ground-based network (e.g., the Internet).

The LAN interface 240 may provide communication signals to, and receive communication signals from, an external LAN. For example, the LAN interface 240 may be coupled to the Internet 108 either directly or through the infrastructure 106, as illustrated in FIG. 1. The LAN interface 240 is well known in the art, and therefore is not described in detail herein.

The gateway interface 245 may provide communication signals to, and receive communication signals from, one or more other gateways associated with the satellite communication system 100 of FIG. 1 (and/or to/from gateways associated with other satellite communication systems, not shown for simplicity). For some implementations, the gateway interface 245 may communicate with other gateways via one or more dedicated communication lines or channels (not shown for simplicity). For other implementations, the gateway interface 245 may communicate with other gateways using the PSTN interface 230 and/or other networks such as the Internet 108 (see also FIG. 1). For at least one implementation, the gateway interface 245 may communicate with other gateways via the infrastructure 106.

Overall gateway control may be provided by the gateway controller 250. The gateway controller 250 may plan and control utilization of the satellite 300's resources by the gateway 200. For example, the gateway controller 250 may analyze trends, generate traffic plans, allocate satellite resources, monitor (or track) satellite positions, and monitor the performance of the gateway 200 and/or the satellite 300. The gateway controller 250 may also be coupled to a ground-based satellite controller (not shown for simplicity) that maintains and monitors orbits of the satellite 300, relays satellite usage information to the gateway 200, tracks the positions of the satellite 300, and/or adjusts various channel settings of the satellite 300.

For the example implementation illustrated in FIG. 2, the gateway controller 250 includes a local time, frequency, and position references 251, which may provide local time or frequency information to the RF subsystem 210, the digital subsystem 220, and/or the interfaces 230, 240, and 245. The time or frequency information may be used to synchronize the various components of the gateway 200 with each other and/or with the satellite 300. The local time, frequency, and position references 251 may also provide position information (e.g., ephemeris data) of the satellite 300 to the various components of the gateway 200. Further, although depicted in FIG. 2 as included within the gateway controller 250, for other implementations, the local time, frequency, and position references 251 may be a separate subsystem that is coupled to the gateway controller 250 (and/or to one or more of the digital subsystem 220 and the RF subsystem 210).

Although not shown in FIG. 2 for simplicity, the gateway controller 250 may also be coupled to a network control center (NCC) and/or a satellite control center (SCC). For example, the gateway controller 250 may allow the SCC to communicate directly with the satellite 300, for example, to retrieve ephemeris data from the satellite 300. The gateway controller 250 may also receive processed information (e.g., from the SCC and/or the NCC) that allows the gateway controller 250 to properly aim the antennas 205 (e.g., at the satellite 300), to schedule beam transmissions, to coordinate handovers, and to perform various other well-known functions.

Figure 3:
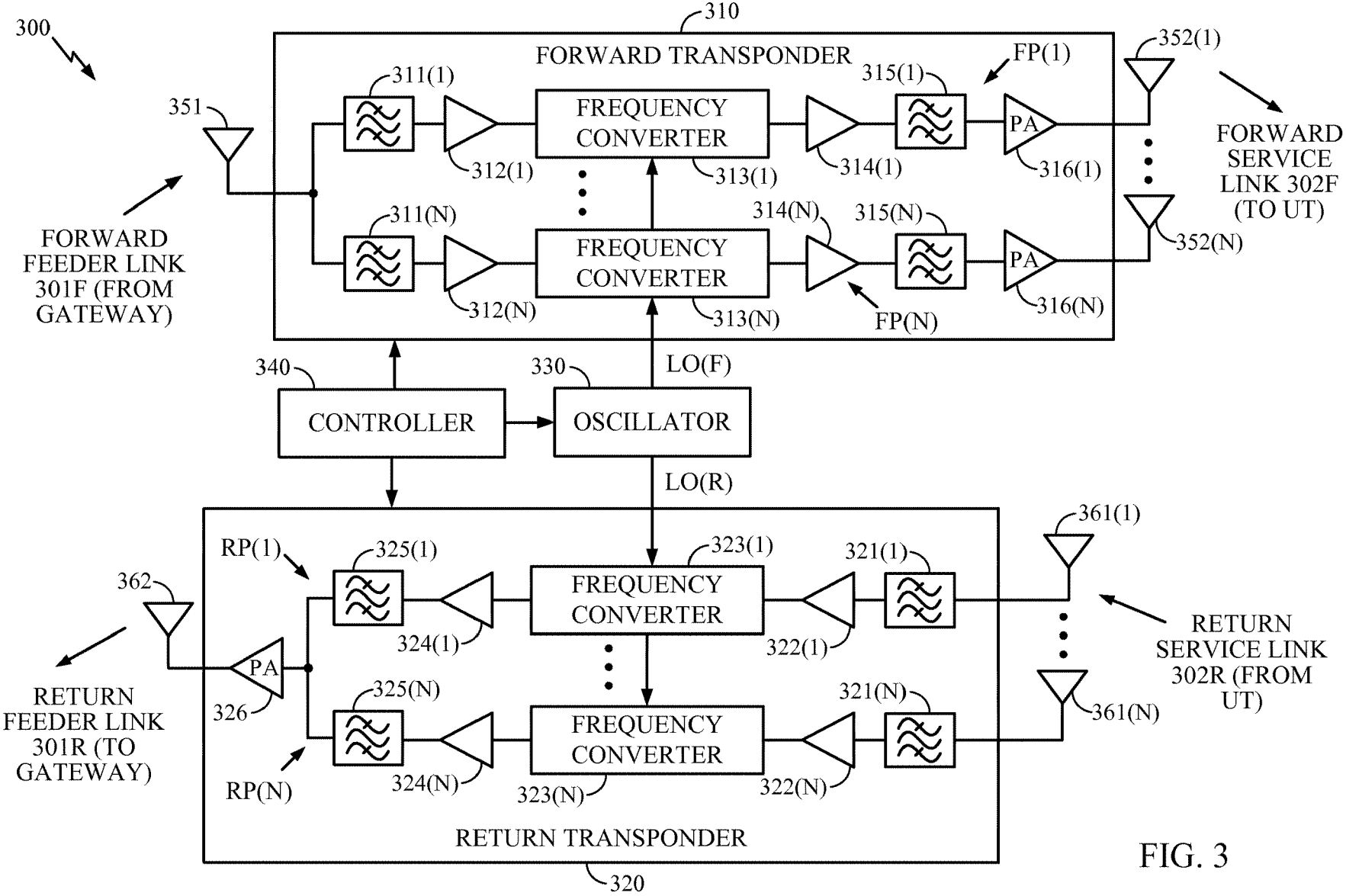
FIG. 3 is a block diagram of an example of the satellite of FIG. 1.

FIG. 3 is an example block diagram of the satellite 300 for illustrative purposes only. It will be appreciated that specific satellite configurations can vary significantly and may or may not include on-board processing. Further, although illustrated as a single satellite, two or more satellites using inter-satellite communication may provide the functional connection between the gateway 200 and the UT 400. It will be appreciated that disclosure is not limited to any specific satellite configuration and any satellite or combinations of satellites that can provide the functional connection between the gateway 200 and the UT 400 can be considered within the scope of the disclosure. In one example, the satellite 300 is shown to include a forward transponder 310, a return transponder 320, an oscillator 330, a controller 340, forward link antennas 352(1)-352(N), and return link antennas 361(1)-361(N). The forward transponder 310, which may process communication signals within a corresponding channel or frequency band, may include a respective one of first bandpass filters 311(1)-311(N), a respective one of first LNAs 312(1)-312(N), a respective one of frequency converters 313(1)-313(N), a respective one of second LNAs 314(1)-314(N), a respective one of second bandpass filters 315(1)-315(N), and a respective one of PAs 316(1)-316(N). Each of the PAs 316(1)-316(N) is coupled to a respective one of antennas 352(1)-352(N), as shown in FIG. 3.

Within each of the respective forward paths FP(1)-FP(N), the first bandpass filters 311(1)-311(N) pass signal components having frequencies within the channel or frequency band of the respective forward paths FP(1)-FP(N), and filter signal components having frequencies outside the channel or frequency band of the respective forward paths FP(1)-FP(N). Thus, the pass bands of the first bandpass filters 311(1)-311(N) correspond to the width of the channel associated with the respective forward paths FP(1)-FP(N). The first LNAs 312(1)-312(N) amplify the received communication signals to a level suitable for processing by the frequency converters 313(1)-313(N). The frequency converters 313(1)-313(N) convert the frequency of the communication signals in the respective forward paths FP(1)-FP(N) (e.g., to a frequency suitable for transmission from the satellite 300 to the UT 400). The second LNAs 314(1)-314(N) amplify the frequency-converted communication signals, and the second bandpass filters 315(1)-315(N) filter signal components having frequencies outside of the associated channel width. The PAs 316(1)-316(N) amplify the filtered signals to a power level suitable for transmission to the UT 400 via respective antennas 352(1)-352(N). The return transponder 320, which includes a number N of return paths RP(1)-RP(N), receives communication signals from the UT 400 along return service link 302R via the antennas 361(1)-361(N), and transmits communication signals to the gateway 200 along return feeder link 301R via one or more antennas 362. Each of the return paths RP(1)-RP(N), which may process communication signals within a corresponding channel or frequency band, may be coupled to a respective one of the antennas 361(1)-361(N), and may include a respective one of first bandpass filters 321(1)-321(N), a respective one of first LNAs 322(1)-322(N), a respective one of frequency converters 323(1)-323(N), a respective one of second LNAs 324(1)-324(N), and a respective one of second bandpass filters 325(1)-325(N).

Within each of the respective return paths RP(1)-RP(N), the first bandpass filters 321(1)-321(N) pass signal components having frequencies within the channel or frequency band of the respective return paths RP(1)-RP(N), and filter signal components having frequencies outside the channel or frequency band of the respective return paths RP(1)-RP(N). Thus, the pass bands of the first bandpass filters 321(1)-321(N) may for some implementations correspond to the width of the channel associated with the respective return paths RP(1)-RP(N). The first LNAs 322(1)-322(N) amplify all the received communication signals to a level suitable for processing by the frequency converters 323(1)-323(N). The frequency converters 323(1)-323(N) convert the frequency of the communication signals in the respective return paths RP(1)-RP(N) (e.g., to a frequency suitable for transmission from the satellite 300 to the gateway 200). The second LNAs 324(1)-324(N) amplify the frequency-converted communication signals, and the second bandpass filters 325(1)-325(N) filter signal components having frequencies outside of the associated channel width. Signals from the return paths RP(1)-RP(N) are combined and provided to the one or more antennas 362 via a PA 326. The PA 326 amplifies the combined signals for transmission to the gateway 200.

The oscillator 330, which may be any suitable circuit or device that generates an oscillating signal, provides a forward local oscillator LO(F) signal to the frequency converters 313(1)-313(N) of the forward transponder 310, and provides a return local oscillator LO(R) signal to the frequency converters 323(1)-323(N) of the return transponder 320. For example, the LO(F) signal may be used by the frequency converters 313(1)-313(N) to convert communication signals from a frequency band associated with the transmission of signals from the gateway 200 to the satellite 300 to a frequency band associated with the transmission of signals from the satellite 300 to the UT 400. The LO(R) signal may be used by the frequency converters 323(1)-323(N) to convert communication signals from a frequency band associated with the transmission of signals from the UT 400 to the satellite 300 to a frequency band associated with the transmission of signals from the satellite 300 to the gateway 200.

The controller 340, which is coupled to the forward transponder 310, the return transponder 320, and the oscillator 330, may control various operations of the satellite 300 including (but not limited to) channel allocations. In one aspect, the controller 340 may include a memory coupled to a processor (not shown for simplicity). The memory may include a non-transitory computer-readable medium (e.g., one or more nonvolatile memory elements, such as EPROM, EEPROM, Flash memory, a hard drive, etc.) storing instructions that, when executed by the processor, cause the satellite 300 to perform operations including (but not limited to) those described herein.

Figure 4:
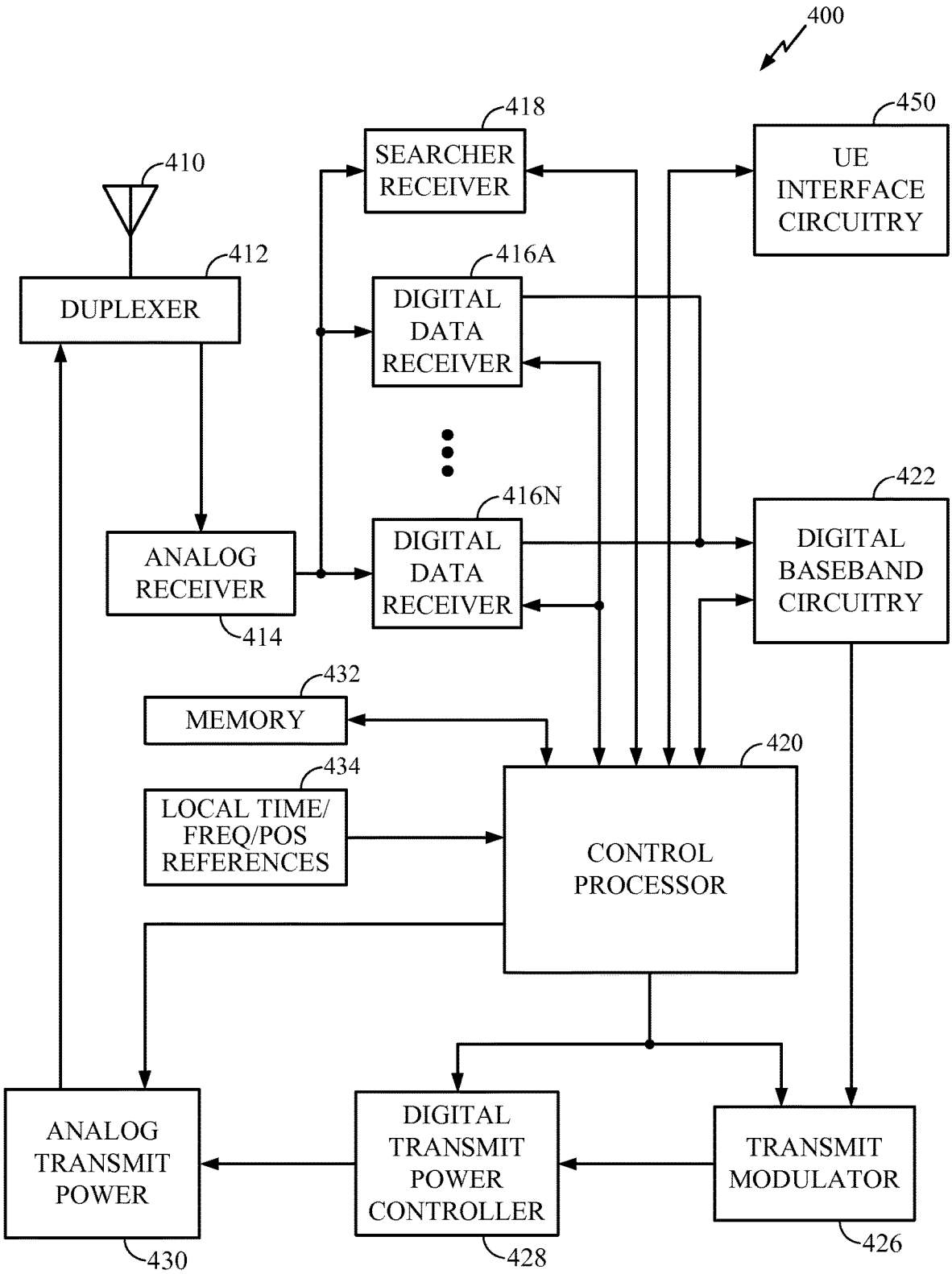
FIG. 4 is a block diagram of an example of the user terminal of FIG. 1.

An example of a transceiver for use in the UT 400 or 401 is illustrated in FIG. 4. In FIG. 4, at least one antenna 410 is provided for receiving forward link communication signals (e.g., from satellite 300), which are transferred to an analog receiver 414, where they are down-converted, amplified, and digitized. A duplexer element 412 is often used to allow the same antenna to serve both transmit and receive functions. Alternatively, the UT 400 may employ separate antennas for operating at different transmit and receive frequencies.

The digital communication signals output by the analog receiver 414 are transferred to at least one digital data receiver 416A-416N and at least one searcher receiver 418. The digital data receivers to 416A-416N can be used to obtain desired levels of signal diversity, depending on the acceptable level of transceiver complexity, as would be apparent to one skilled in the relevant art.

At least one user terminal control processor 420 is coupled to the digital data receivers 416A-416N and the searcher receiver 418. The control processor 420 provides, among other functions, basic signal processing, timing, power and handoff control or coordination, and selection of frequency used for signal carriers. Another basic control function that may be performed by the control processor 420 is the selection or manipulation of functions to be used for processing various signal waveforms. Signal processing by the control processor 420 can include a determination of relative signal strength and computation of various related signal parameters. Such computations of signal parameters, such as timing and frequency may include the use of additional or separate dedicated circuitry to provide increased efficiency or speed in measurements or improved allocation of control processing resources.

The outputs of the digital data receivers 416A-416N are coupled to digital baseband circuitry 422 within the UT 400. The digital baseband circuitry 422 comprises processing and presentation elements used to transfer information to and from UE 500 as shown in FIG. 1, for example. Referring to FIG. 4, if diversity signal processing is employed, the digital baseband circuitry 422 may comprise a diversity combiner and decoder. Some of these elements may also operate under the control of, or in communication with, the control processor 420.

When voice or other data is prepared as an output message or communications signal originating with the UT 400, the digital baseband circuitry 422 is used to receive, store, process, and otherwise prepare the desired data for transmission. The digital baseband circuitry 422 provides this data to a transmit modulator 426 operating under the control of the control processor 420. The output of the transmit modulator 426 is transferred to a digital transmit power controller 428 which provides output power control to an analog transmit power amplifier 430 for final transmission of the output signal from the antenna 410 to a satellite (e.g., satellite 300).

In FIG. 4, the UT 400 also includes a memory 432 associated with the control processor 420. The memory 432 may include instructions for execution by the control processor 420 as well as data for processing by the control processor 420. In the example illustrated in FIG. 4, the memory 432 may include instructions for performing time or frequency adjustments to be applied to an RF signal to be transmitted by the UT 400 via the return service link to the satellite 300.

In the example illustrated in FIG. 4, the UT 400 also includes an optional local time, frequency and/or position references 434 (e.g., a GPS receiver), which may provide local time, frequency and/or position information to the control processor 420 for various applications, including, for example, time or frequency synchronization for the UT 400.

The digital data receivers 416A-N and the searcher receiver 418 are configured with signal correlation elements to demodulate and track specific signals. The searcher receiver 418 is used to search for pilot signals, or other relatively fixed pattern strong signals, while the digital data receivers 416A-N are used to demodulate other signals associated with detected pilot signals. However, the digital data receivers 416A-N can be assigned to track the pilot signal after acquisition to accurately determine the ratio of signal chip energies to signal noise, and to formulate pilot signal strength. Therefore, the outputs of these units can be monitored to determine the energy in, or frequency of, the pilot signal or other signals. These digital data receivers 416A-N also employ frequency tracking elements that can be monitored to provide current frequency and timing information to the control processor 420 for signals being demodulated.

The control processor 420 may use such information to determine to what extent the received signals are offset from the oscillator frequency, when scaled to the same frequency band, as appropriate. This, and other information related to frequency errors and frequency shifts, can be stored in the memory 432 as desired.

The control processor 420 may also be coupled to UE interface circuitry 450 to allow communications between the UT 400 and one or more UEs. The UE interface circuitry 450 may be configured as desired for communication with various UE configurations and accordingly may include various transceivers and related components depending on the various communication technologies employed to communicate with the various UEs supported. For example, the UE interface circuitry 450 may include one or more antennas, a wide area network (WAN) transceiver, a wireless local area network (WLAN) transceiver, a Local Area Network (LAN) interface, a Public Switched Telephone Network (PSTN) interface and/or other known communication technologies configured to communicate with one or more UEs in communication with the UT 400.

Figure 5:
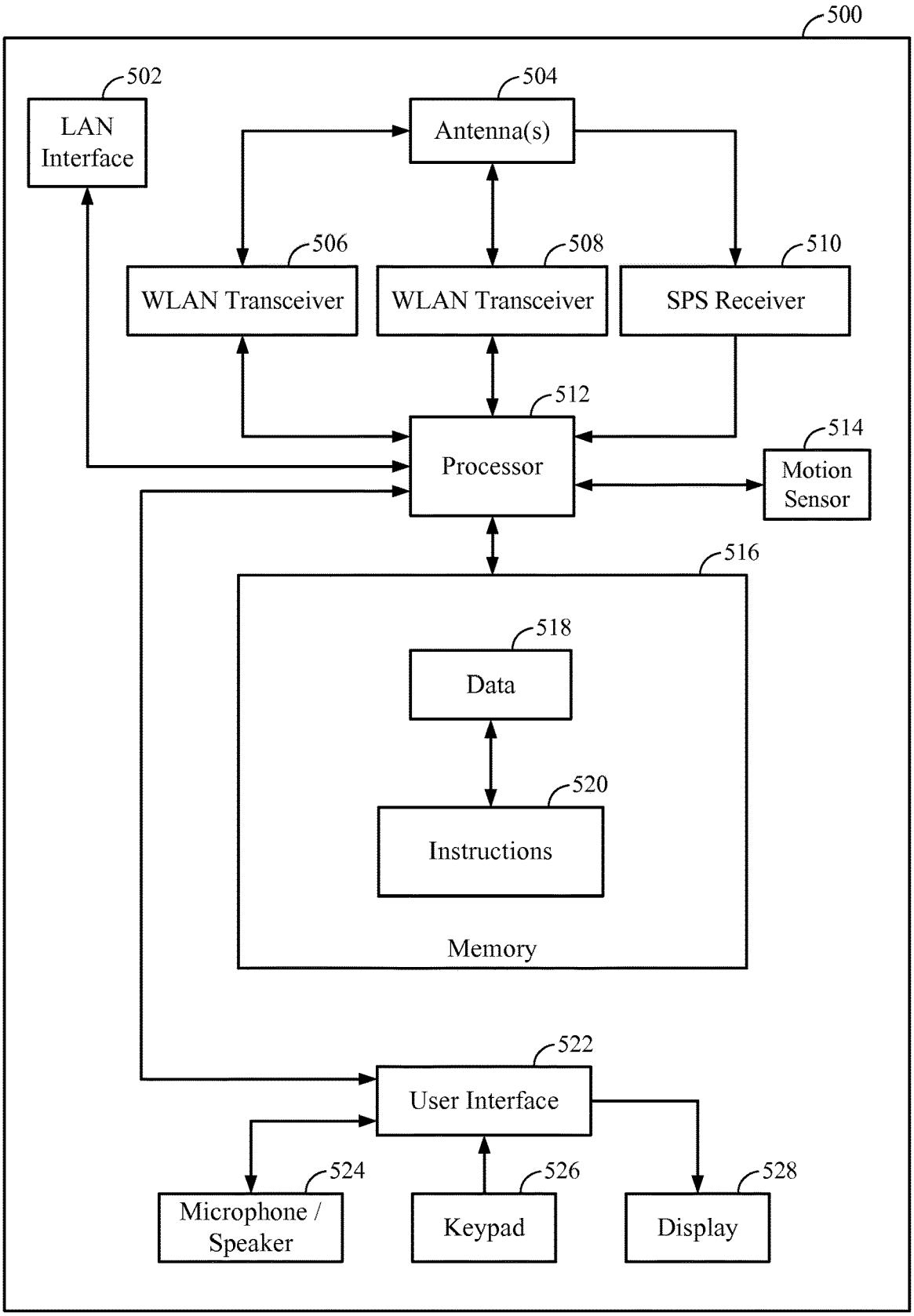
FIG. 5 is a block diagram of an example of the user equipment of FIG. 1.

FIG. 5 is a block diagram illustrating an example of the UE 500, which also can apply to the UE 501 of FIG. 1. The UE 500 as shown in FIG. 5 may be a mobile device, a handheld computer, a tablet, a wearable device, a smart watch, or any type of device capable of interacting with a user, for example. Additionally, the UE 500 may be a network side device that provides connectivity to various ultimate end user devices and/or to various public or private networks. In the example shown in FIG. 5, the UE 500 may comprise a LAN interface 502, one or more antennas 504, a wide area network (WAN) transceiver 506, a wireless local area network (WLAN) transceiver 508, and a satellite positioning system (SPS) receiver 510. The SPS receiver 510 may be compatible with the Global Positioning System (GPS), the Global Navigation Satellite System (GLONASS) and/or any other global or regional satellite based positioning system. In an alternate aspect, the UE 500 may include the WLAN transceiver 508, such as a Wi-Fi transceiver, with or without the LAN interface 502, the WAN transceiver 506, and/or the SPS receiver 510, for example. Further, the UE 500 may include additional transceivers such as Bluetooth®, ZigBee®, and other known technologies, with or without the LAN interface 502, the WAN transceiver 506, the WLAN transceiver 508 and/or the SPS receiver 510. Accordingly, the elements illustrated for the UE 500 are provided merely as an example configuration and are not intended to limit the configuration of UEs in accordance with the various aspects disclosed herein.

In the example shown in FIG. 5, a processor 512 is connected to the LAN interface 502, the WAN transceiver 506, the WLAN transceiver 508 and the SPS receiver 510. Optionally, a motion sensor 514 and other sensors may also be coupled to the processor 512.

A memory 516 is connected to the processor 512. In one aspect, the memory 516 may include data 518 which may be transmitted to and/or received from the UT 400, as shown in FIG. 1. Referring to FIG. 5, the memory 516 may also include stored instructions 520 to be executed by the processor 512 to perform the process steps for communicating with the UT 400, for example. Furthermore, the UE 500 may also include a user interface 522, which may include hardware and software for interfacing inputs or outputs of the processor 512 with the user through light, sound or tactile inputs or outputs, for example. In the example shown in FIG. 5, the UE 500 includes a microphone/speaker 524, a keypad 526, and a display 528 connected to the user interface 522. Alternatively, the user's tactile input or output may be integrated with the display 528 by using a touch-screen display, for example. Once again, the elements illustrated in FIG. 5 are not intended to limit the configuration of the UEs disclosed herein and it will be appreciated that the elements included in the UE 500 will vary based on the end use of the device and the design choices of the system engineers.

Additionally, the UE 500 may be a user device such as a mobile device or external network side device in communication with but separate from the UT 400 as illustrated in FIG. 1, for example. Alternatively, the UE 500 and the UT 400 may be integral parts of a single physical device.

Figure 6:
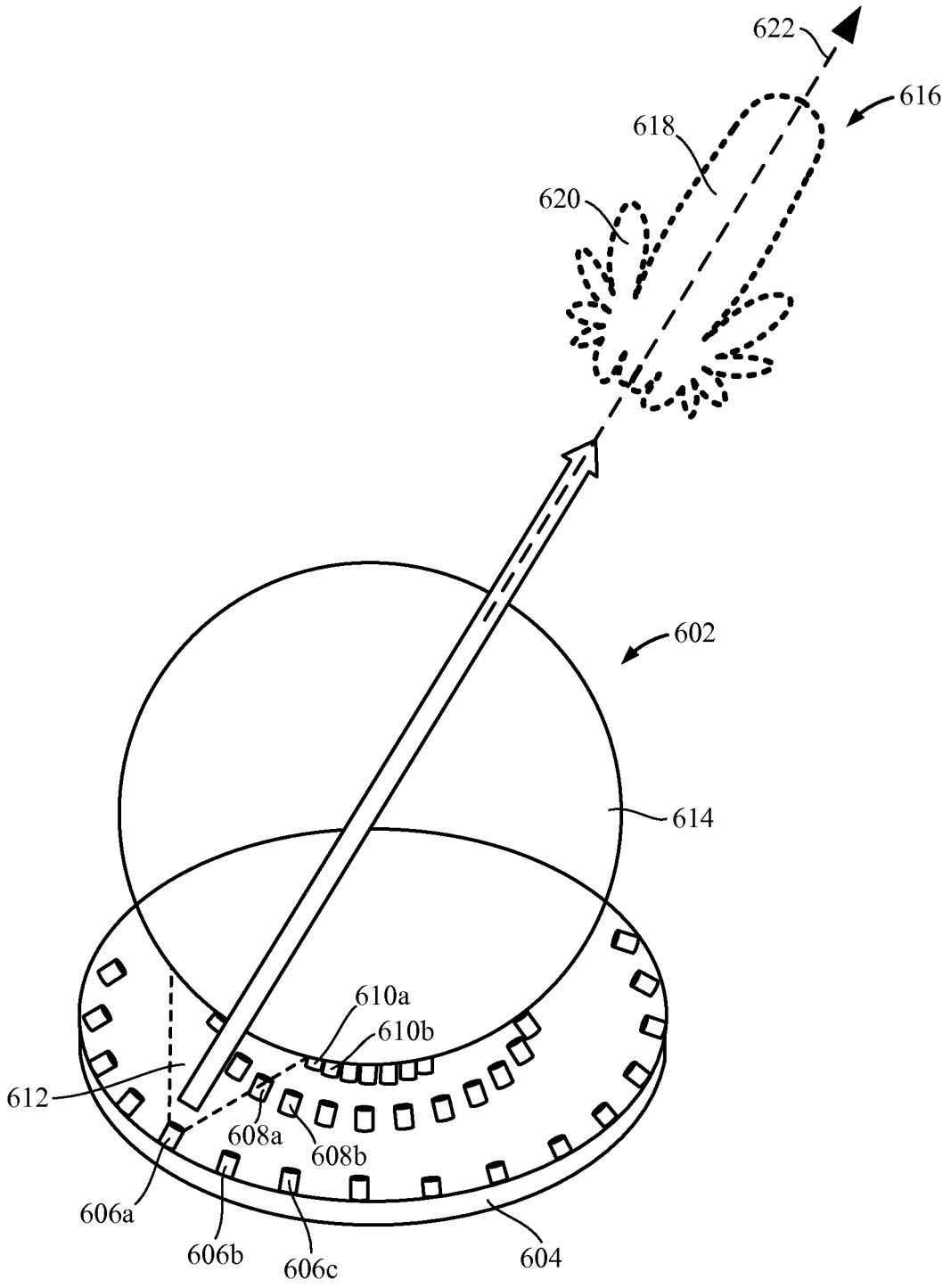
FIG. 6 is a diagram illustrating an example of an antenna capable of beam steering for use in a user terminal in a satellite communication system.

FIG. 6 is a diagram illustrating an example of an antenna capable of beam steering for use in a user terminal in a satellite communication system. Such an antenna may be implemented as an antenna 410 in the transceiver of the UT 400 in FIG. 4, for example. Referring to FIG. 6, a steerable beam antenna 602 includes an antenna feed structure 604 comprising a plurality of feed elements 606*a*, 606*b*, 606*c*, . . . , 608*a*, 608*b*, . . . , 610*a*, 610*b*, . . . . In one aspect, at least one of the feed elements 606*a*, 606*b*, 606*c*, . . . , 608*a*, 608*b*, . . . , 610*a*, 610*b*, . . . are configured to be switched on or off to form an initial beam.

In one aspect, each of the feed elements 606*a*, 606*b*, 606*c*, . . . , 608*a*, 608*b*, . . . , 610*a*, 610*b*, . . . in the antenna feed structure 604 may be selectively switched on or off. In a further aspect, only one of the feed elements 606*a*, 606*b*, 606*c*, . . . , 608*a*, 608*b*, . . . , 610*a*, 610*b*, . . . may be selectively turned on at a given time to generate an initial beam at a desired direction, while all other feed elements 606*a*, 606*b*, 606*c*, . . . , 608*a*, 608*b*, . . . , 610*a*, 610*b*, . . . are either turned off or kept in an off state. In the example shown in FIG. 6, the feed element 606*a* of the antenna feed structure 604 is turned on, that is, transmitting radio frequency (RF) power, while all the other feed elements are either turned off or kept in an off state, that is, not transmitting RF power, to generate an initial beam having an initial beam pattern 612 as illustrated in FIG. 6.

In one aspect, the antenna feed structure 604 comprises a waveguide feed structure. In alternative aspects, other types of feeds may also be used to generate initial beam patterns at desired radio frequencies. In one aspect, the feed elements 606*a*, 606*b*, 606*c*, . . . , 608*a*, 608*b*, . . . , 610*a*, 610*b*, . . . in the antenna feed structure 604 may comprise waveguide feeds, for example, active waveguide feeds. In a further aspect, each of the active waveguide feeds may comprise a circular polarization source for generating circularly polarized radio waves.

In one aspect, circular polarization of radio waves for transmission and reception of RF signals in a satellite communication system may be desirable because the relative orientation of a waveguide feed of a transmit/receive antenna of a user terminal with respect to a waveguide feed of a receive/transmit antenna of a satellite in communication with the user terminal may change over time. If the radio waves are linearly instead of circularly polarized, a horizontally polarized radio wave transmitted by a source (either a satellite or a user terminal) may not be received, or received with significant attenuation, by a destination (either a user terminal or a satellite) whose antenna feed is oriented for vertical polarization. On the other hand, if the radio waves are circularly polarized, attenuation associated with linear polarization due to imperfect alignments in the orientations of transmit and receive antenna feeds can be avoided.

In one aspect, the antenna feed structure 604 as illustrated in FIG. 6 has a structure of a circular plate. In one aspect, the feed elements 606*a*, 606*b*, 606*c*, . . . 608*a*, 608*b*, . . . , 610*a*, 610*b*, . . . as illustrated in FIG. 6 are arranged in a pattern of three concentric circles on the antenna feed structure 604, with the feed elements 606*a*, 606*b*, 606*c*, . . . on the outer circle, the feed elements 608*a*, 608*b*, . . . on the middle circle, and the feed elements 610*a*, 610*b*, . . . on the inner circle. In alternative aspects, the feed elements 606*a*, 606*b*, 606*c*, . . . 608*a*, 608*b*, . . . , 610*a*, 610*b*, . . . may be patterned differently on the antenna feed structure 604.

In one aspect, it is desirable that a user terminal be able to communicate with satellites at various positions in a non-geosynchronous satellite constellation. As described above, the position of any given satellite in a non-geosynchronous satellite constellation relative to a user terminal may change over time. Moreover, the user terminal may need to terminate communications with one satellite and to initiate communications with another satellite, in a process called a handover or handoff. For these applications, the user terminal may be required to steer a beam over a wide range of azimuth angles and a wide range of elevation angles at a high rate of directional change. In one aspect, the arrangement of the feed elements 606*a*, 606*b*, 606*c*, . . . 608*a*, 608*b*, . . . , 610*a*, 610*b*, . . . in multiple concentric rings or circles on the antenna feed structure 604, such as a circular plate structure as illustrated in FIG. 6, allows the direction of the beam to be changed over a wide range of azimuth angles and a wide range of elevation angles.

In one aspect, the steerable beam antenna 602 as illustrated in FIG. 6 further includes a focus lens 614 positioned adjacent to the antenna feed structure 604. In a further aspect, the focus lens 614 is a spherical lens for focusing the initial beam transmitted by one of the feed elements 606*a*, 606*b*, 606*c*, . . . 608*a*, 608*b*, . . . , 610*a*, 610*b*, . . . on the antenna feed structure 604 to form a focused beam. For example, as illustrated in FIG. 6, if the feed element 606*a* is switched on to transmit an initial beam having the initial beam pattern 612 while other feed elements on the antenna feed structure 604 are off, the focus lens 614 focuses the initial beam transmitted by the feed element 606*a* to form a focused beam having a focused beam pattern 616.

The focused beam pattern 616 may have a main lobe 618 and a plurality of side lobes 620. The main lobe 618 of the focused beam pattern 616 may be centered about an axis 622 at which the antenna gain is at its peak. In one aspect, one of the feed elements 606*a*, 606*b*, 606*c*, . . . 608*a*, 608*b*, . . . , 610*a*, 610*b*, . . . on the antenna feed structure 604, at a location that is directly opposite, or most nearly directly opposite, the serving satellite from the center of the focus lens 614, is selected to be switched on, such that the serving satellite is at or near the axis 622 of the main lobe 618 of the focused beam pattern 616 of the user terminal 400. The positioning of the feed elements 606*a*, 606*b*, 606*c*, . . . 608*a*, 608*b*, . . . , 610*a*, 610*b*, . . . in the antenna feed structure 604 with respect to the focus lens 614 will be described in further detail below with reference to FIG. 8, and antenna beam patterns will be described in further detail below with reference to FIG. 9.

Figure 7:
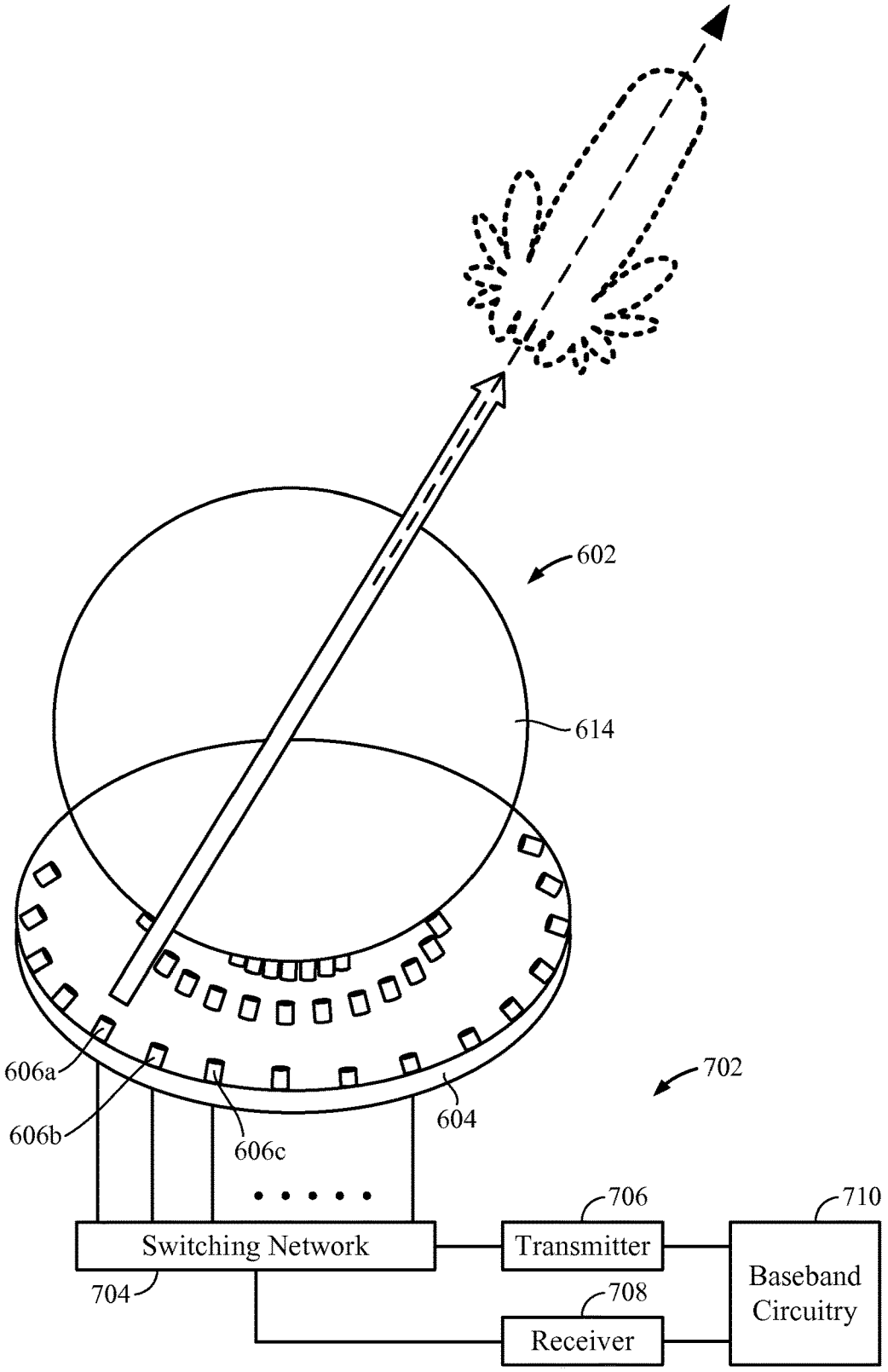
FIG. 7 is a diagram illustrating an example of a user terminal capable of beam steering in a satellite communication system.

FIG. 7 is a diagram illustrating an example of a user terminal capable of beam steering in a satellite communication system. In FIG. 7, a user terminal 702 includes the steerable beam antenna 602 as illustrated in FIG. 6 and described above, a switching network 704 coupled to the feed elements 606*a*, 606*b*, 606*c*, . . . 608*a*, 608*b*, . . . , 610*a*, 610*b*, . . . on the antenna feed structure 604 of the steerable beam antenna 602, a transmitter 706 and a receiver 708 coupled to the switching network 704, and baseband circuitry 710 coupled to the transmitter 706 and the receiver 708.

In one aspect, the switching network 704 is coupled to each of the feed elements 606*a*, 606*b*, 606*c*, . . . 608*a*, 608*b*, . . . , 610*a*, 610*b*, . . . on the antenna feed structure 604 to selectively switch each of the feed elements 606*a*, 606*b*, 606*c*, . . . 608*a*, 608*b*, . . . , 610*a*, 610*b*, . . . on or off. In one aspect, only one of the feed elements 606*a*, 606*b*, 606*c*, . . . 608*a*, 608*b*, . . . , 610*a*, 610*b*, . . . is turned on while all other feed elements 606*a*, 606*b*, 606*c*, . . . 608*a*, 608*b*, . . . , 610*a*, 610*b*, . . . on the antenna feed structure 604 are turned off to generate an initial beam in a desired direction, and the initial beam is focused by the focus lens 614 to form a focused beam having a main lobe 618 directed at a satellite.

In FIG. 7, the transmitter 706 is coupled to the switching network 704 to transmit an RF signal to the antenna feed structure 604 through the switching network 704. In one aspect, a single transmitter 706 is connected to the switching network 704, which selectively turns on one of the feed elements 606*a*, 606*b*, 606*c*, . . . 608*a*, 608*b*, . . . , 610*a*, 610*b*, . . . on the antenna feed structure 604 to transmit the RF signal generated by the single transmitter 706. Thus, instead of forming a phased-array antenna beam pattern with multiple beams fed from multiple antenna feed elements, there is no need to implement multiple RF transmitters, multiple phase shifters, or multiple attenuators to form a phased-array antenna beam pattern in the configuration illustrated in FIG. 7. Without expensive RF components required for phased-array beam forming, cost savings can be realized for a user terminal that is required to perform fast beam scanning over a wide range of angles in azimuth and in elevation.

As illustrated in FIG. 7, the user terminal 702 also includes the receiver 708 coupled to the switching network 704 for receiving an RF signal from one of the feed elements 606*a*, 606*b*, 606*c*, . . . 608*a*, 608*b*, . . . , 610*a*, 610*b*, . . . on the antenna feed structure 604 which is switched on by the switching network 704 to receive the RF signal from a satellite. In one aspect, the transmitter 706 and the receiver 708 are coupled to the baseband circuitry 710 to process baseband signals for data, voice, video or other types of information.

As illustrated in FIGS. 6 and 7, the focus lens 614 allows the user terminals 602 and 702 to achieve a uniform antenna beam pattern, that is, without a scan loss which is typically present in conventional planar phased array-antenna systems, over a wide field-of-view in both azimuth and elevation. In one aspect, the antenna feed structure 604 with switchable feed elements 606*a*, 606*b*, 606*c*, . . . 608*a*, 608*b*, . . . , 610*a*, 610*b*, . . . allows the antenna beam to point at a desired angular location in space. In one aspect, the switching network 704, which acts as a beam steering control unit, is capable of selectively switching on one of the feed elements 606*a*, 606*b*, 606*c*, . . . 608*a*, 608*b*, . . . , 610*a*, 610*b*, . . . while switching the other feed elements 606*a*, 606*b*, 606*c*, . . . 608*a*, 608*b*, . . . , 610*a*, 610*b*, . . . off or maintaining the other feed elements 606*a*, 606*b*, 606*c*, . . . 608*a*, 608*b*, . . . , 610*a*, 610*b*, . . . in an off state.

In the examples shown in FIGS. 6 and 7, the antenna feed structure 604 is implemented as a planar structure with multiple open-ended switchable waveguide feed elements that can be individually turned on or off to point the antenna beam toward a satellite that provides communication service, that is, a serving satellite. In one aspect, the number of switchable waveguide feed elements and their locations on the antenna feed structure 604, as well as the size and position of the focus lens 614, may be determined based on various design factors, including, for example, the minimum required antenna gain, the steerable beam resolution, that is, the maximum allowable angular separation between two immediately adjacent steerable beams, as well as other design factors.

Figure 8:
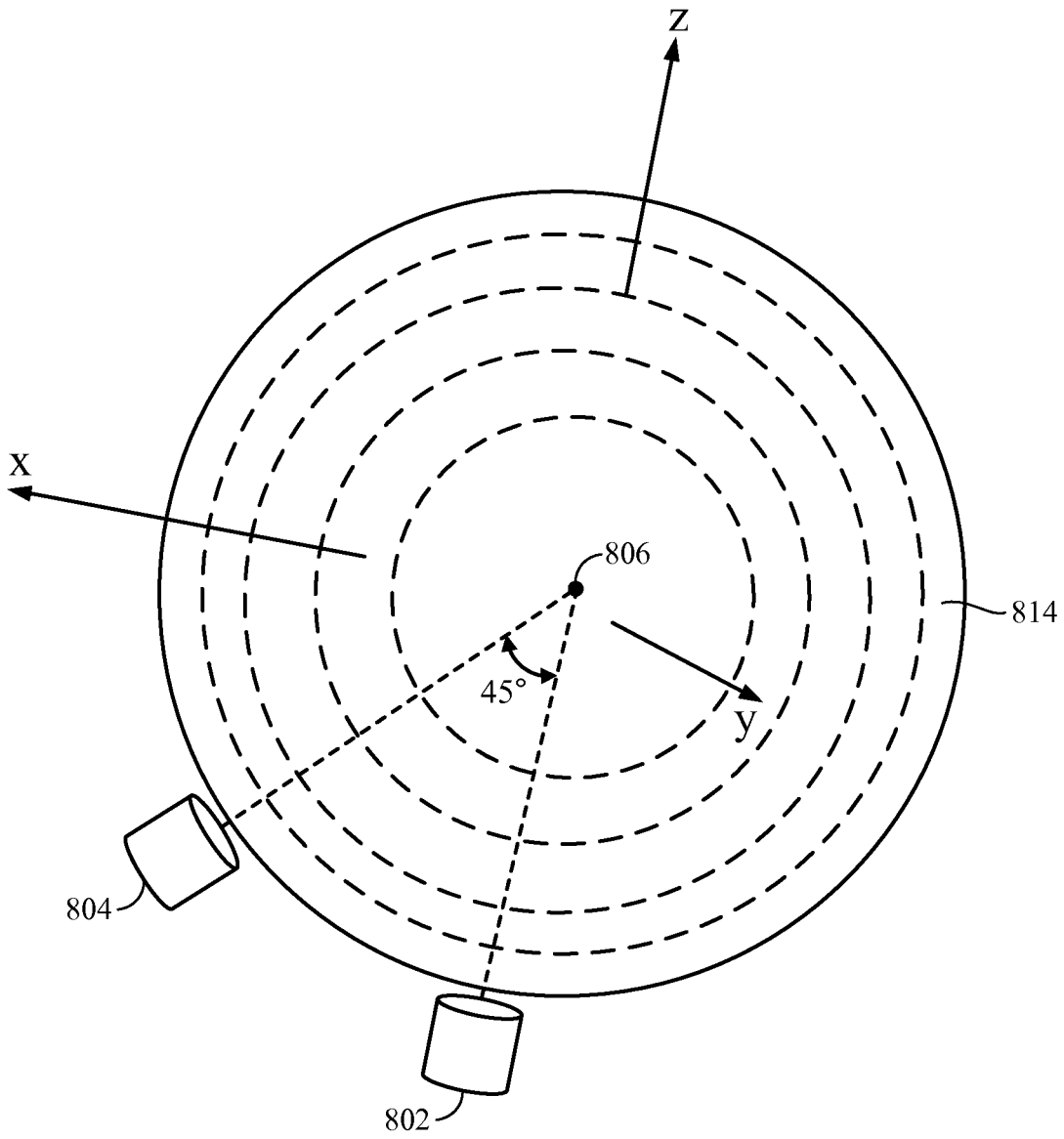
FIG. 8 is a diagram illustrating an example of a portion of an antenna with two antenna feeds and a spherical lens for use in a user terminal in a satellite communication system.

FIG. 8 is a diagram illustrating an example of a portion of an antenna structure showing two antenna feeds and a spherical lens for use in a user terminal in a satellite communication system. In FIG. 8, two antenna feeds 802 and 804 and a spherical lens 814 are shown. In one aspect, the two antenna feeds 802 and 804 as shown in FIG. 8 may be two of the feed elements 606*a*, 606*b*, 606*c*, . . . 608*a*, 608*b*, . . . , 610*a*, 610*b*, . . . on the antenna feed structure 604 as shown in FIG. 6. In one aspect, the spherical lens 814 as shown in FIG. 8 may be the same as the focus lens 614 as shown in FIGS. 6 and 7.

Referring to FIG. 8, the two antenna feeds 802 and 804 are spaced apart from each other. For example, the first antenna feed 802 may be oriented in a direction coinciding with the z-axis in FIG. 8, whereas the second antenna feed 804 may be oriented at an angle of −45° with respect to the z-axis. In one aspect, each of the antenna feeds 802 and 804 comprises an active waveguide feed capable of generating a circularly polarized beam. In one aspect, each of the antenna feeds 802 and 804 is aimed at the center 806 of the spherical lens 814, which is also the origin (0, 0, 0) of the three-dimensional Cartesian coordinates (x, y, z) as shown in FIG. 8. In this configuration, the spherical lens 814 is positioned to focus a beam transmitted from any of the antenna feeds 802 and 804 regardless of where each of the antenna feeds 802 and 804 is positioned relative to the x, y and z axes.

Figure 9:
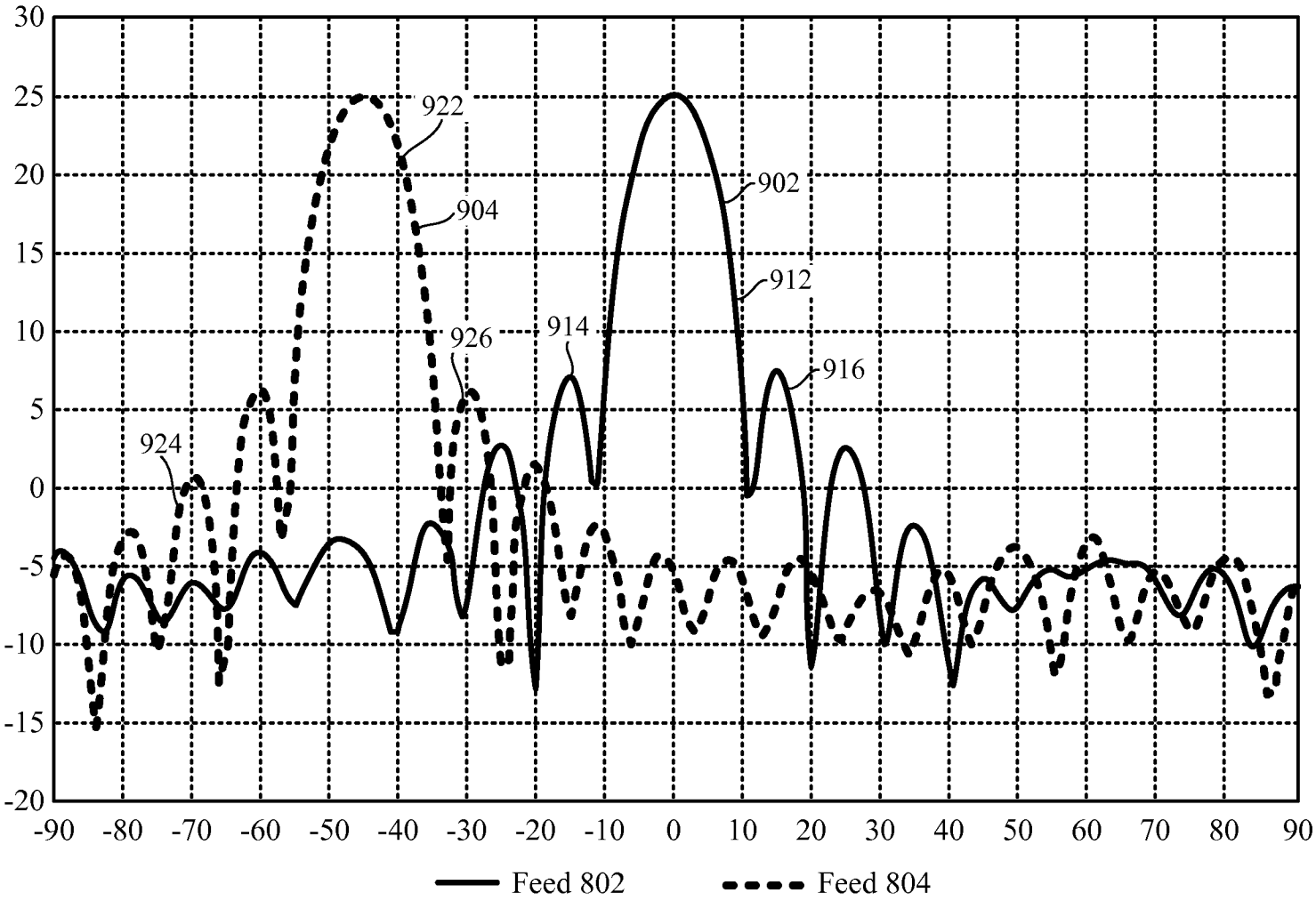
FIG. 9 is a graph illustrating an example of antenna beam patterns generated by the two antenna feeds in the antenna of FIG. 8.

FIG. 9 is a graph illustrating an example of antenna beam patterns generated by the two antenna feeds 802 and 804 of FIG. 8. In the graph shown in FIG. 9, the abscissa represents the angle of a given antenna feed with respect to the z-axis as illustrated in FIG. 8, and the ordinate represents the antenna gain in dBi (gain in decibels relative to an isotropic radiator). The beam generated by the first antenna feed 802 and focused by the spherical lens 814 as shown in FIG. 8 has an antenna gain illustrated by a first curve 902 in FIG. 9, whereas the beam generated by the second antenna feed 804 and focused by the spherical lens 814 as shown in FIG. 8 has an antenna gain illustrated by a second curve 904 in FIG. 9.

Referring to FIG. 9, the first curve 902 has a main lobe 912 and a plurality of side lobes including side lobes 914 and 916. The main lobe 912 of the first curve 902 is centered about 0° with respect to the z-axis as shown in FIG. 9, because the first antenna feed 802 as shown in FIG. 8 is aimed at a direction coinciding with the z-axis. On the other hand, the second curve 904 has a main lobe 922 and a plurality of side lobes including side lobes 924 and 926 as shown in FIG. 9. The main lobe 922 of the second curve 904 is centered about −45° with respect to the z-axis as shown in FIG. 9, because the second antenna feed 804 as shown in FIG. 8 is aimed at an angle of −45° with respect to the z-axis. In the example illustrated in FIG. 8, the first and second antenna feeds 802 and 804 have an identical structure except that they are offset at an angle of 45° with respect to one another. Thus, in FIG. 9, the antenna gain curves 902 and 904 for respective first and second antenna feeds 802 and 804 are identical, except that the antenna gain curve 904 for the second antenna feed 804 is shifted by −45° on the abscissa relative to the antenna gain curve 902 for the first antenna feed 802.

Figure 10:
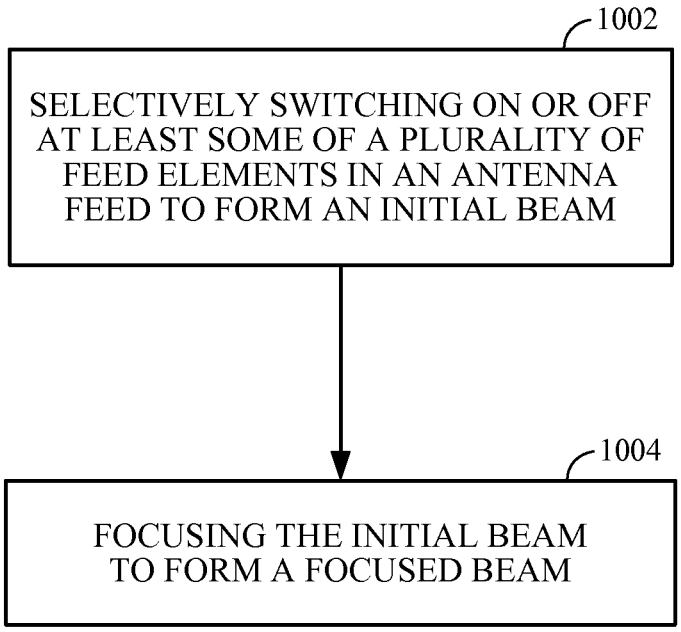
FIG. 10 is a flowchart illustrating an example of a method of antenna beam steering.

FIG. 10 is a flowchart illustrating an example of a method of antenna beam steering. In FIG. 10, a process of selectively switching on or off at least one of a plurality of feed elements in an antenna feed structure to form an initial beam is shown in block 1002, and a process of focusing the initial beam to form a focused beam is shown in block 1004. In one aspect, the process of selectively switching on or off at least one of the feed elements in the antenna feed structure to form an initial beam may be performed by the switching network 704 as shown in FIG. 7, for example. In one aspect, the process of focusing the initial beam to form a focused beam in block 1004 may be performed by the focus lens 614 as shown in FIGS. 6 and 7, or by the spherical lens 814 as shown in FIG. 8.

In one aspect, the process of selectively switching on or off at least one of the feed elements in the antenna feed structure to form the initial beam in block 1002 may include the processes of switching on a first feed element and switching off a second feed element among the plurality of feed elements in the antenna feed structure to steer the focused beam in a first direction, and switching on the second feed element and switching off the first feed element to steer the focused beam in a second direction different from the first direction. By selectively switching the individual feed elements in the antenna feed structure on and off, fast beam scanning is achieved. Examples of selectively switching the feed elements on and off to steer a beam pattern at a desired direction are described above with respect to FIGS. 6-9.

In one aspect, the method of antenna beam steering further includes processes of estimating an angular position of the satellite relative to the user terminal, and steering the focused beam in a direction at least substantially in alignment with the angular position of the satellite. In one aspect, the process of estimating the angular position of the satellite relative to the user terminal may be performed by a searcher receiver, such as the searcher receiver 418 as illustrated in FIG. 4 and described above. Alternatively, the angular position of the satellite relative to the user terminal may be estimated in various other manners, for example, by using ephemeris data of the satellite, that is, the known orbit of the satellite. In one aspect, the process of steering the focused beam in a direction at least substantially in alignment with the angular position of the satellite relative to the user terminal may be performed by the switching network 704 as shown in FIG. 7, for example, which selectively switches on one of the feed elements 606*a*, 606*b*, 606*c*, . . . 608*a*, 608*b*, . . . , 610*a*, 610*b*, . . . of the antenna feed structure 604, to direct the beam generated by the feed elements 606*a*, 606*b*, 606*c*, . . . 608*a*, 608*b*, . . . , 610*a*, 610*b*, . . . and focused by the focus lens 614 toward the satellite.

In one aspect, the antenna feed structure 604 may be mechanically steered, rotationally and/or laterally, with respect to the focus lens 614. In one aspect, the antenna feed structure 604 is capable of mechanical movements with respect to the focus lens 614, such that the beams can be mechanically steered in addition to being electronically steered by selectively switching the feed elements 606*a*, 606*b*, 606*c*, . . . 608*a*, 608*b*, . . . , 610*a*, 610*b*, . . . on the feed plate of the antenna feed structure 604. When a beam is switched from one feed element to another, as illustrated in FIG. 9 and described above, the antenna gain is generally lower at cross-over portions of the beams, for example, between side lobe 914 of the first curve 902 and side lobe 926 of the second curve 904, as shown in FIG. 9. By introducing minor mechanical movements of the antenna feed structure 604 rotationally and/or laterally, an adjacent beam can be moved to fill in the cross-over portions of antenna beam patterns.

In one aspect, the user terminal may communicate with different satellites in a constellation of communication satellites at different periods of time. As described above, the user terminal performs a handover or handoff when it terminates communications with one satellite and initiates communications with another satellite. In one aspect, the method of antenna beam steering further includes processes of estimating a first angular position of the first satellite relative to the user terminal, steering the focused beam in a first direction at least substantially in alignment with the first angular position to communicate with the first satellite in a first time period, estimating a second angular position of the second satellite relative to the user terminal, and steering the focused beam in a second direction at least substantially in alignment with the second angular position to communicate with the second satellite in a second time period.

In one aspect, the angular positions of the first and second satellites relative to the user terminal may be performed by a searcher receiver, such as the searcher receiver 418 as illustrated in FIG. 4 and described above. Alternatively, the angular positions of the satellites in a known constellation of satellites in a communication network may be estimated in various other manners, for example, by using ephemeris data of the satellites. In one aspect, beam steering in different directions for communications with different satellites at different periods of time may be performed by the switching network 704 as shown in FIG. 7, for example.

In one aspect, the antenna beam may be steered in different directions nearly instantaneously, as the speed of changing the direction of the antenna beam is limited by the speed of the switching network 704 in FIG. 7 to switch the feed elements 606*a*, 606*b*, 606*c*, . . . 608*a*, 608*b*, . . . , 610*a*, 610*b*, . . . on and off, thus allowing the user terminal to perform beam steering at a much faster rate than conventional mechanical antenna beam steering systems. In one aspect, selective switching of the feed elements 606*a*, 606*b*, 606*c*, . . . 608*a*, 608*b*, . . . , 610*a*, 610*b*, . . . on the antenna feed structure 604 as shown in FIGS. 6 and 7 obviates the need for expensive RF components such as multiple active RF transmitters, phase shifters, or attenuators to achieve beam steering by conventional phased-array antennas. Moreover, with the spherical lens 814 in the example shown in FIG. 8, a focused beam with a large antenna gain can be formed regardless of the relative angular positions of the individual antenna feeds, such as the antenna feeds 802 and 804, with respect to the x, y and z axes as shown in FIG. 8.

Figure 11:
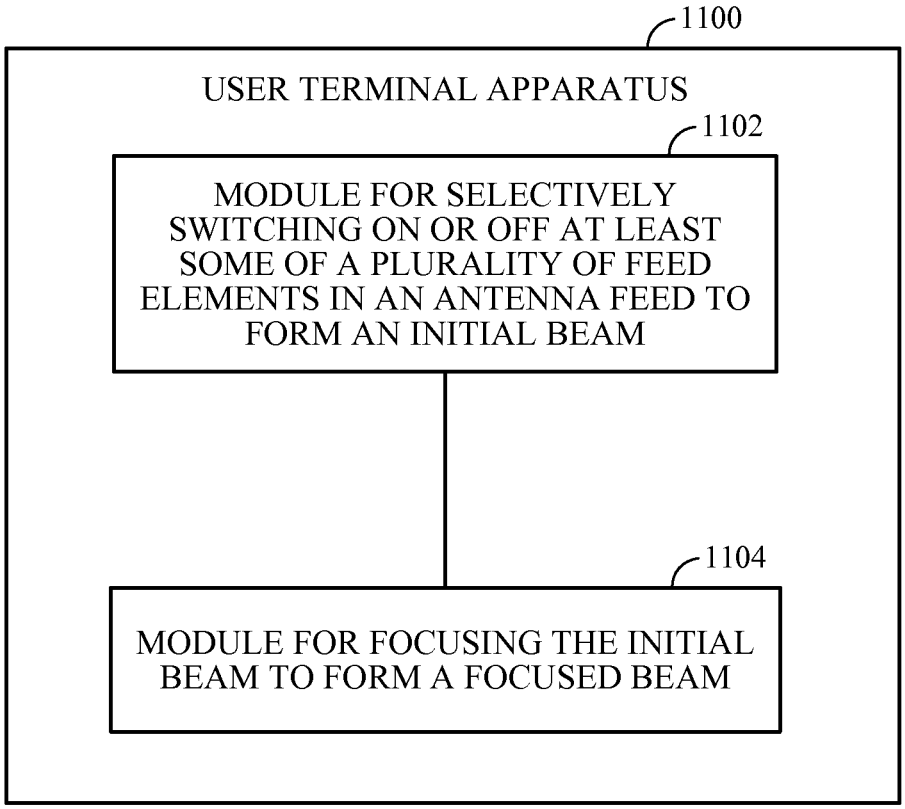
FIG. 11 illustrates an example of a user terminal apparatus represented as a series of interrelated functional modules.

FIG. 11 illustrates an example of a user terminal apparatus 1100 represented as a series of interrelated functional modules. A module 1102 for selectively switching on or off at least one of a plurality of feed elements in an antenna feed structure to form an initial beam may correspond, at least in some aspects to, for example, a switching network (e.g., the switching network 704 or the like) or a component thereof as discussed herein. A module 1104 for focusing the initial beam to form a focused beam may correspond, at least in some aspects to, for example, a focus lens (e.g., the focus lens 614 or the like) or a component thereof as discussed herein.

The functionality of the modules of FIG. 11 may be implemented in various ways consistent with the teachings herein. In some designs, the functionality of these modules may be implemented as one or more electrical and/or optical components. In some designs, the functionality of one or more of these blocks may be implemented as a processing system including one or more processor components. In some designs, the functionality of one or more of these modules may be implemented using, for example, at least a portion of one or more integrated circuits (e.g., an ASIC). As discussed herein, an integrated circuit may include a processor, software, other related components, or some combination thereof. Thus, the functionality of different modules may be implemented, for example, as different subsets of an integrated circuit, as different subsets of a set of software modules, or a combination thereof. Also, it will be appreciated that a given subset (e.g., of an integrated circuit and/or of a set of software modules) may provide at least a portion of the functionality for more than one module.

In addition, the components and functions represented by FIG. 11, as well as other components and functions described herein, may be implemented using any suitable means. Such means also may be implemented, at least in part, using corresponding structure as taught herein. For example, the components described above in conjunction with the "module for" components of FIG. 11 also may correspond to similarly designated "means for" functionality. Thus, in some aspects one or more of such means may be implemented using one or more of hardware components, processor components, integrated circuits, or other suitable structure as taught herein.

Those of skill in the art will appreciate that information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

Further, those of skill in the art will appreciate that the various illustrative logical blocks, modules, circuits, and algorithm steps described in connection with the aspects disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the disclosure.

The methods, sequences, or algorithms described in connection with the aspects disclosed herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An example of a storage medium is coupled to the processor such that the processor can read information from, and write information to, the storage medium. In the alternative, the storage medium may be integral to the processor.

Accordingly, one aspect of the disclosure can include a computer-readable media embodying a method for time or frequency synchronization in non-geosynchronous satellite communication systems. Accordingly, the disclosure is not limited to illustrated examples and any means for performing the functionality described herein are included in aspects of the disclosure.

While the foregoing disclosure shows illustrative aspects, it should be noted that various changes and modifications could be made herein without departing from the scope of the appended claims. The functions, steps, or actions of the method claims in accordance with aspects described herein need not be performed in any particular order unless expressly stated otherwise. Furthermore, although elements may be described or claimed in the singular, the plural is contemplated unless limitation to the singular is explicitly stated.

What is claimed is:

1. A user terminal, comprising:

a transceiver; and an antenna coupled to the transceiver, the antenna comprising:

a planar antenna feed structure comprising a plurality of feed elements, at least one of the feed elements configured to be switched on or off to form an initial beam without independent mechanical movement of the at least one feed element relative to any other feed element among the plurality of feed elements; and a spherical focus lens positioned adjacent to the antenna feed structure to form a focused beam based on the initial beam, wherein the plurality of feed elements includes a first subset of feed elements arranged on a first concentric arc relative to the focus lens and a second subset of feed elements arranged on a second concentric arc relative to the focus lens, and wherein the first and second concentric arcs differ in terms of radial distance relative to a center of the focus lens.

2. The user terminal of claim 1, wherein each of the feed elements comprises a waveguide feed.

3. The user terminal of claim 2, wherein the initial beam comprises a circularly polarized beam.

4. The user terminal of claim 1, wherein the antenna feed structure is mechanically steerable with respect to the focus lens.

5. The user terminal of claim 1, wherein the plurality of feed elements comprise at least a first active feed element and a second active feed element spaced apart from each other, wherein the first active feed element is configured to generate a first beam pattern centered in a first direction, and wherein the second active feed element is configured to generate a second beam pattern centered in a second direction different from the first direction.

6. The user terminal of claim 5, wherein the first and second active feed elements are each configured to be switched on and off to steer the focused beam between the first direction and the second direction.

7. The user terminal of claim 1, wherein the transceiver comprises a single transmitter coupled to the antenna.

8. The user terminal of claim 1, wherein the user terminal comprises a satellite user terminal for communication with one or more satellites.

9. The user terminal of claim 1, wherein the at least one feed element is configured to be switched on or off to steer the initial beam to track with a serving satellite of the user terminal.

10. The user terminal of claim 1, wherein the first and second concentric arcs correspond to first and second concentric circles.

11. An antenna, comprising:

a planar antenna feed structure comprising a plurality of feed elements, at least one of the feed elements configured to be switched on or off to form an initial beam without independent mechanical movement of the at least one feed element relative to any other feed element among the plurality of feed elements; and a spherical focus lens positioned adjacent to the antenna feed structure to form a focused beam based on the initial beam, wherein the plurality of feed elements includes a first subset of feed elements arranged on a first concentric arc relative to the focus lens and a second subset of feed elements arranged on a second concentric arc relative to the focus lens, and wherein the first and second concentric arcs differ in terms of radial distance relative to a center of the focus lens.

12. The antenna of claim 11, wherein each of the feed elements comprises a waveguide feed.

13. The antenna of claim 12, wherein the initial beam comprises a circularly polarized beam.

14. The antenna of claim 11, wherein the antenna feed structure is mechanically steerable with respect to the focus lens.

15. The antenna of claim 11, wherein the plurality of feed elements comprise at least a first active feed element and a second active feed element spaced apart from each other, wherein the first active feed element is configured to generate a first beam pattern centered in a first direction, and wherein the second active feed element is configured to generate a second beam pattern centered in a second direction different from the first direction.

16. The antenna of claim 15, wherein the first and second active feed elements are each configured to be switched on and off to steer the focused beam between the first direction and the second direction.

17. The antenna of claim 11, wherein the antenna comprises an antenna coupled to a single transmitter in a user terminal.

18. The antenna of claim 17, wherein the user terminal comprises a satellite user terminal for communication with one or more satellites.

19. A method of steering a beam, comprising:

selectively switching on or off at least one of a plurality of feed elements in a planar antenna feed structure to form an initial beam without independent mechanical movement of the at least one feed element relative to any other feed element among the plurality of feed elements; and focusing, by a spherical focus lens, the initial beam to form a focused beam based on the initial beam, wherein the plurality of feed elements includes a first subset of feed elements arranged on a first concentric arc relative to the focus lens and a second subset of feed elements arranged on a second concentric arc relative to the focus lens, and wherein the first and second concentric arcs differ in terms of radial distance relative to a center of the focus lens.

20. The method of claim 19, wherein selectively switching on or off at least one of the feed elements in the antenna feed structure to form the initial beam comprises:

switching on a first one of the feed elements and switching off a second one of the feed elements to steer the focused beam in a first direction; and switching on the second feed element and switching off the first feed element to steer the focused beam in a second direction different from the first direction.

21. The method of claim 19, wherein the antenna feed structure comprises an antenna feed structure in a user terminal in communication with a satellite, the method further comprising:

estimating an angular position of the satellite relative to the user terminal; and steering the focused beam in a direction at least substantially in alignment with the angular position of the satellite.

22. The method of claim 19, wherein the antenna feed structure comprises an antenna feed structure in a user terminal in communication with a plurality of satellites including a first satellite and a second satellite, the method further comprising:

estimating a first angular position of the first satellite relative to the user terminal;

steering the focused beam in a first direction at least substantially in alignment with the first angular position to communicate with the first satellite in a first time period;

estimating a second angular position of the second satellite relative to the user terminal; and steering the focused beam in a second direction at least substantially in alignment with the second angular position to communicate with the second satellite in a second time period.

23. A beam steering apparatus, comprising:

means for selectively switching on or off at least one of a plurality of feed elements in a planar antenna feed structure to form an initial beam without independent mechanical movement of the at least one feed element relative to any other feed element among the plurality of feed elements; and a spherical focus lens to form a focused beam based on the initial beam, wherein the plurality of feed elements includes a first subset of feed elements arranged on a first concentric arc relative to the spherical focus lens and a second subset of feed elements arranged on a second concentric arc relative to the spherical focus lens, and wherein the first and second concentric arcs differ in terms of radial distance relative to a center of the spherical focus lens.

24. The apparatus of claim 23, wherein the means for selectively switching on or off at least one of the feed elements in the antenna feed structure to form the initial beam comprises:

means for switching on a first one of the feed elements and switching off a second one of the feed elements to steer the focused beam in a first direction; and means for switching on the second feed element and switching off the first feed element to steer the focused beam in a second direction different from the first direction.

25. The apparatus of claim 23, wherein the antenna feed structure comprises an antenna feed structure in a user terminal in communication with a satellite, the apparatus further comprising:

means for estimating an angular position of the satellite relative to the user terminal; and means for steering the focused beam in a direction at least substantially in alignment with the angular position of the satellite.

26. The apparatus of claim 23, wherein the antenna feed structure comprises an antenna feed structure in a user terminal in communication with a plurality of satellites including a first satellite and a second satellite, the apparatus further comprising:

means for estimating a first angular position of the first satellite relative to the user terminal;

means for steering the focused beam in a first direction at least substantially in alignment with the first angular position to communicate with the first satellite in a first time period;

means for estimating a second angular position of the second satellite relative to the user terminal; and means for steering the focused beam in a second direction at least substantially in alignment with the second angular position to communicate with the second satellite in a second time period.

27. The apparatus of claim 23, wherein the spherical focus lens the initial beam to form a focused beam comprises a focus lens positioned adjacent to the antenna feed structure.

28. The apparatus of claim 23, wherein each of the feed elements comprises a waveguide feed.

29. The apparatus of claim 28, wherein the initial beam comprises a circularly polarized beam.

30. The apparatus of claim 23, wherein the antenna feed structure is mechanically steerable with respect to the focus lens.

31. The apparatus of claim 23, wherein the plurality of feed elements comprise at least a first active feed element and a second active feed element spaced apart from each other, wherein the first active feed element is configured to generate a first beam pattern centered in a first direction, and wherein the second active feed element is configured to generate a second beam pattern centered in a second direction different from the first direction.

* * * * *